US006851653B2

(12) United States Patent
Crowley et al.

(10) Patent No.: US 6,851,653 B2
(45) Date of Patent: Feb. 8, 2005

(54) SUPPORT SYSTEM FOR LOADS

(75) Inventors: Robert O. Crowley, Tucson, AZ (US); Patrick M. Lane, Tucson, AZ (US); Erik H. Binnie, Tucson, AZ (US)

(73) Assignee: AGM Container Controls, Inc., Tucson, AZ (US)

( * ) Notice: Subject to any disclaimer, the term of this patent is extended or adjusted under 35 U.S.C. 154(b) by 0 days.

(21) Appl. No.: 10/387,887

(22) Filed: Mar. 13, 2003

(65) Prior Publication Data

US 2004/0178309 A1 Sep. 16, 2004

(51) Int. Cl.[7] ..... A47G 29/00; A47B 57/00

(52) U.S. Cl. ..... 248/244; 211/192

(58) Field of Search ..... 248/244, 235, 248/241, 242, 243, 245, 246, 250, 236, 295.11, 297.21, 297.31; 108/152, 144.11; 211/192

(56) References Cited

U.S. PATENT DOCUMENTS 845,917 A * 3/1907 Worley et al. ..... 211/90.02
1,307,610 A * 6/1919 Yeagley ..... 248/244
1,702,937 A * 2/1929 Friedemann ..... 248/243
3,097,822 A * 7/1963 Attwood ..... 248/250
3,392,848 A * 7/1968 McConnell et al. ..... 211/192
3,612,290 A * 10/1971 Evans ..... 211/192
3,905,712 A * 9/1975 McConnell ..... 403/317
3,966,158 A * 6/1976 Boundy ..... 248/243
4,955,743 A * 9/1990 King ..... 403/254
5,316,253 A * 5/1994 Flathau et al. ..... 248/235
5,791,502 A * 8/1998 Bietz et al. ..... 211/192

* cited by examiner

*Primary Examiner*—Anita M. King
(74) *Attorney, Agent, or Firm*—Quarles & Brady Streich Lang, LLP

(57) ABSTRACT

A system for supporting loads includes a track having uniformly spaced apertures separated by necks. A bracket is mounted on the track and has two groups of studs which are positioned in the necks and prevent the bracket from pulling away from the track. Neighboring studs in both groups have identical center-to-center spacings. Two plugs pass through holes in the bracket and into respective ones of the apertures. The plugs fix the bracket against movement relative to the track longitudinally and transversely of the latter. The distance between a plug hole and any stud equals one-half the center-to-center spacing of neighboring studs of a group or an integral multiple of one-half such spacing. A locking member passes through an additional hole in the bracket and frictionally engages the track to prevent the plugs from pulling out of the respective apertures during an impact.

26 Claims, 12 Drawing Sheets

SUPPORT SYSTEM FOR LOADS

BACKGROUND OF THE INVENTION

1. Field of the Invention

The invention relates to a system for supporting loads.

2. Description of the Prior Art

A conventional system for mounting shelves includes two tracks which are secured to a wall at a predetermined distance from each other. The tracks, which are parallel to one another, run vertically. Each track has an undercut groove extending longitudinally thereof, and uniformly spaced, circular apertures in one surface of each track open into the respective grooves. Neighboring apertures are separated from one another by slots narrower than the apertures.

A triangular bracket or brace made of plate is mounted on each track. One leg of each bracket is equipped with a flange which carries elements for positioning a shelf on the bracket and locking the shelf in place. A second leg of each bracket is also equipped with a flange, and this flange carries elements for anchoring the bracket to one of the tracks. The anchoring elements of each bracket are spaced from one another by the same distance as the apertures in the tracks. The anchoring elements have heads which can be inserted in the apertures and can then slide along the groove of the respective track. This allows the height of the bracket to be adjusted. Each bracket is positioned with the heads of the anchoring elements in register with the narrow slots between the apertures. This traps the heads in the grooves and prevents the bracket from being pulled out of the track. Once the brackets have been fixed in place, a shelf is mounted on the brackets.

Once a bracket has been properly positioned along the respective track, the associated anchoring elements are individually tightened to fix the bracket against movement longitudinally of the track. After both brackets have been secured, a shelf is mounted on the brackets.

SUMMARY OF THE INVENTION

One aspect of the invention resides in a support system. The system comprises a brace or bracket provided with a plurality of first elements defining respective first positions for a plurality of anchoring members designed to inhibit movement of the brace in a first direction. The brace is further provided with at least one second element defining at least one second position for at least one arresting member designed to inhibit movement of the brace in a second direction different from the first direction. The plurality of first elements includes two pairs of elements which are arranged so that the two elements of each pair have substantially the same predetermined center-to-center spacing. The second element and at least one selected first element of the two pairs of elements have a center-to-center spacing different from the predetermined spacing and from an integral multiple of the predetermined spacing.

Another aspect of the invention resides in a bracing method. The method comprises the steps of anchoring a brace at a plurality of first locations of the brace so as to inhibit movement of the brace in a first direction, and arresting the brace at a minimum of one second location of the brace so as to inhibit movement of the brace in a second direction different from the first direction. The plurality of first locations includes two pairs of locations arranged so that the two locations of each pair have substantially the same predetermined center-to-center spacing. The second location and at least one selected first location of the two pairs of locations have a center-to-center spacing different from the predetermined spacing and from an integral multiple of the predetermined spacing.

The first locations and the second location may be arranged in a row. The second location and selected first location preferably have a center-to-center spacing substantially equal to one-half of the predetermined spacing, one and one-half times the predetermined spacing, or an integral multiple of the predetermined spacing plus one-half of the predetermined spacing.

To better inhibit movement of the brace in the second direction, the brace can be arrested at an additional second location thereof. The additional second location and selected first location advantageously again have a center-to-center spacing different from the predetermined spacing and from an integral multiple of the predetermined spacing. On the other hand, the two second locations may have a center-to-center spacing substantially equal to the predetermined spacing or an integral multiple of such spacing.

The arresting step can involve moving an arresting member from a retracted inoperative condition to an extended operative condition at one or both of the second locations. The arresting member or members may be biased towards the extended operative condition or conditions. If an arresting member is moved from a retracted inoperative condition to an extended operative condition at each of the second locations, it is possible to move the two arresting members to the respective extended positions substantially in tandem.

The method can further comprise the step of locking an arresting member against movement away from the respective second location.

Additional features and advantages of the invention will be forthcoming from the following detailed description of specific embodiments when read in conjunction with the accompanying drawings.

DESCRIPTION OF THE PREFERRED EMBODIMENTS

Figure 1:
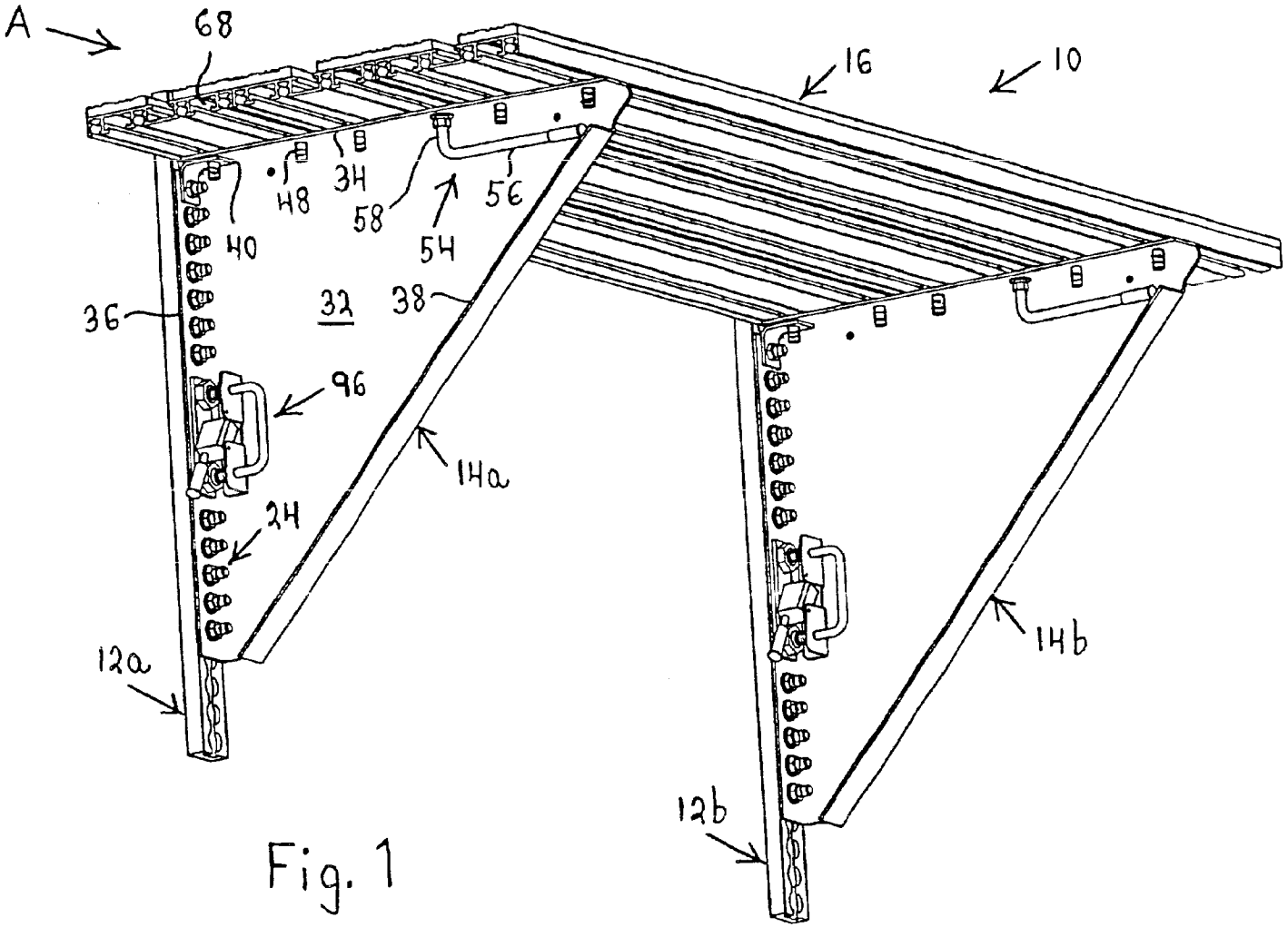
FIG. 1 is a bottom perspective view of a system for supporting loads which is designed in accordance with the invention and includes a shelf, two mounting brackets for the shelf, a track for each mounting bracket, an arresting and locking unit for each mounting bracket and locking units for the shelf.

Referring to FIG. 1, the numeral 10 identifies a support system for loads designed according to the invention. The support system 10 includes two tracks or elongated, strip-shaped mounting members 12*a* and 12*b* which are secured to a non-illustrated surface, such as the surface of a wall, in a conventional manner. The tracks 12*a*, 12*b* are spaced from and parallel to one another and are arranged vertically.

A mounting bracket or brace 14*a* is anchored to the track 12*a* while a mounting bracket or brace 14*b* is anchored to the track 12*b*. The mounting brackets 14*a*, 14*b* carry a shelf 16.

The tracks 12*a*, 12*b* are identical and will be further described with reference to the track 12*a*. Similarly, the mounting brackets 14*a*, 14*b* are identical and will be described in greater detail with reference to the bracket 14*a*.

Figure 2:
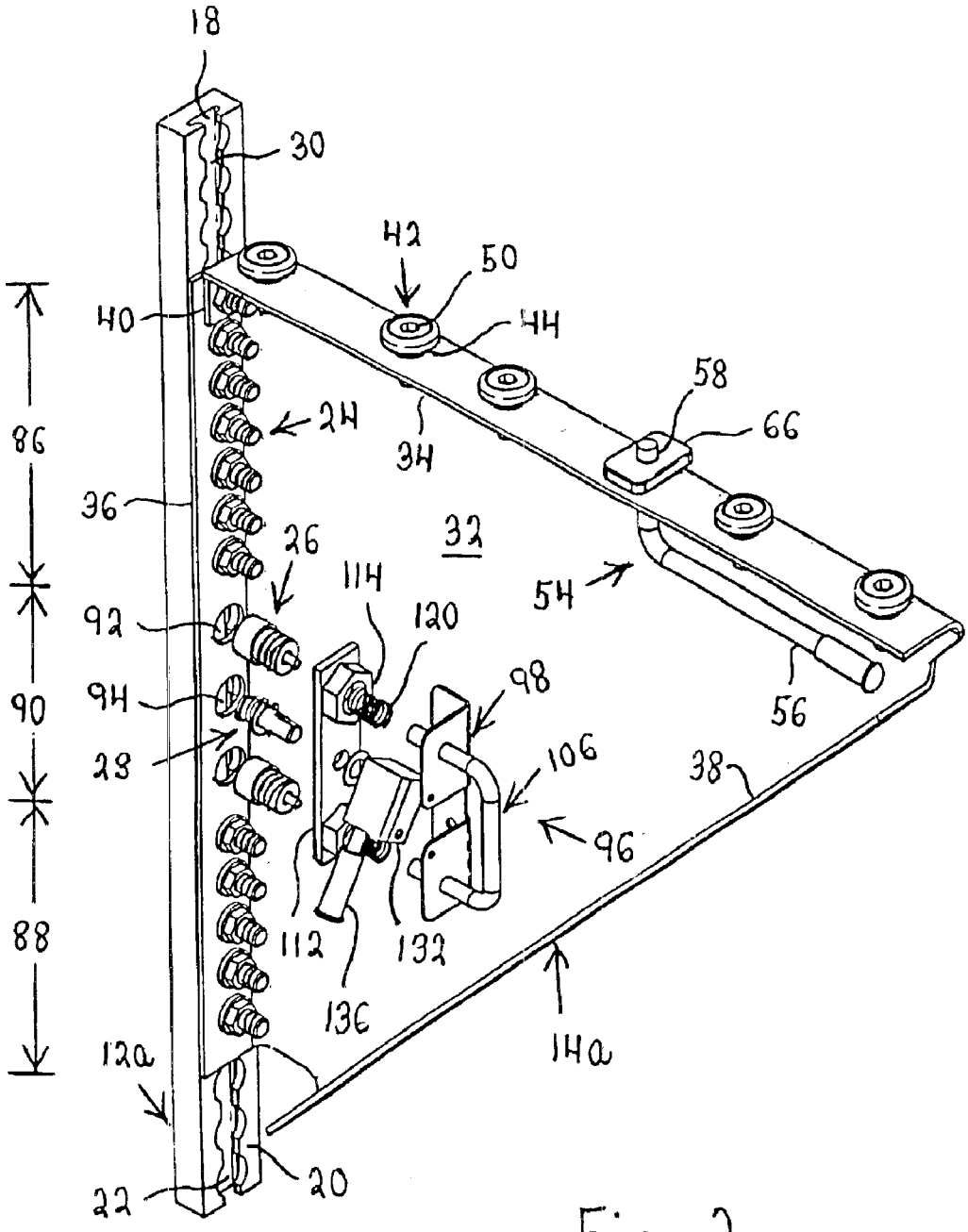
FIG. 2 is a side perspective view of one of the tracks and one of the mounting brackets of FIG. 1 and includes an exploded view of the arresting and locking unit for such mounting bracket.

Considering FIG. 2 in conjunction with FIG. 1, the track 12*a* is provided with a dovetailed or undercut groove 18 which extends longitudinally and runs the length of the track 12*a*. The track 12*a* has an anchoring surface 20 and a series of apertures or openings 22 is formed in the anchoring surface 20. All of the apertures 22 have the same size, and each of the apertures 22 extends from the anchoring surface 20 to the dovetailed groove 18. The apertures 22 are arranged in a straight row running longitudinally of the track 12*a*, and neighboring apertures 22 have the same center-to-center spacing. The apertures 22 define receiving positions for studs or anchoring members 24, plugs or arresting members 26 and a locking member 28, and the apertures 22 are dimensioned to receive the studs 24, the plugs 26 and the locking member 28 with clearance. The studs 24 are designed to anchor the mounting bracket 14*a* to the track 12*a* while the plugs 26 are designed to prevent or inhibit movement of the bracket 14*a* along the track 12*a*. The locking member 28 is designed to prevent or inhibit withdrawal of the plugs 26 from the respective apertures 22 which accommodate the plugs 26.

Neighboring ones of the apertures 22 are separated from one another by necks or slots 30 which are narrower than the apertures 22. The necks 30 extend from the anchoring surface 20 of the track 12*a* to the dovetailed groove 18 and each of the necks 30 accordingly has an undercut, Once the studs 24 have been introduced into the apertures 22, the studs 24 are slidable along the track 12*a* into the necks 30. When the studs 24 are located in the necks 30, the necks 30 prevent the studs 24 from being pulled out of the track 12*a* thereby causing the mounting bracket 14*a* to be anchored to the track 12*a*. The necks 30 may be considered to constitute retaining elements which cooperate with the studs 24 to inhibit movement of the mounting bracket 14*a* away from the track 12*a*.

The mounting bracket 14*a* includes a right-angled, approximately triangular plate or sheet 32 having strip-shaped flanges 34, 36 and 38 which run longitudinally of the respective edges of the plate 32. When the plate 32 is mounted on the track 12*a* as in FIG. 1, the flange 34 is horizontal and the shelf 16 rests on the flange 34. On the other hand, the flange 36 is vertical and lies against the track 12*a*. The flange 38 extends diagonally in a direction from one of the flanges 34,36 to the other. The flanges 34,36, which are located on the two edges of the plate 32 running perpendicular to one another, are joined to each other by an angle iron 40 which constitutes an advantageous feature but can be omitted.

Figure 3:
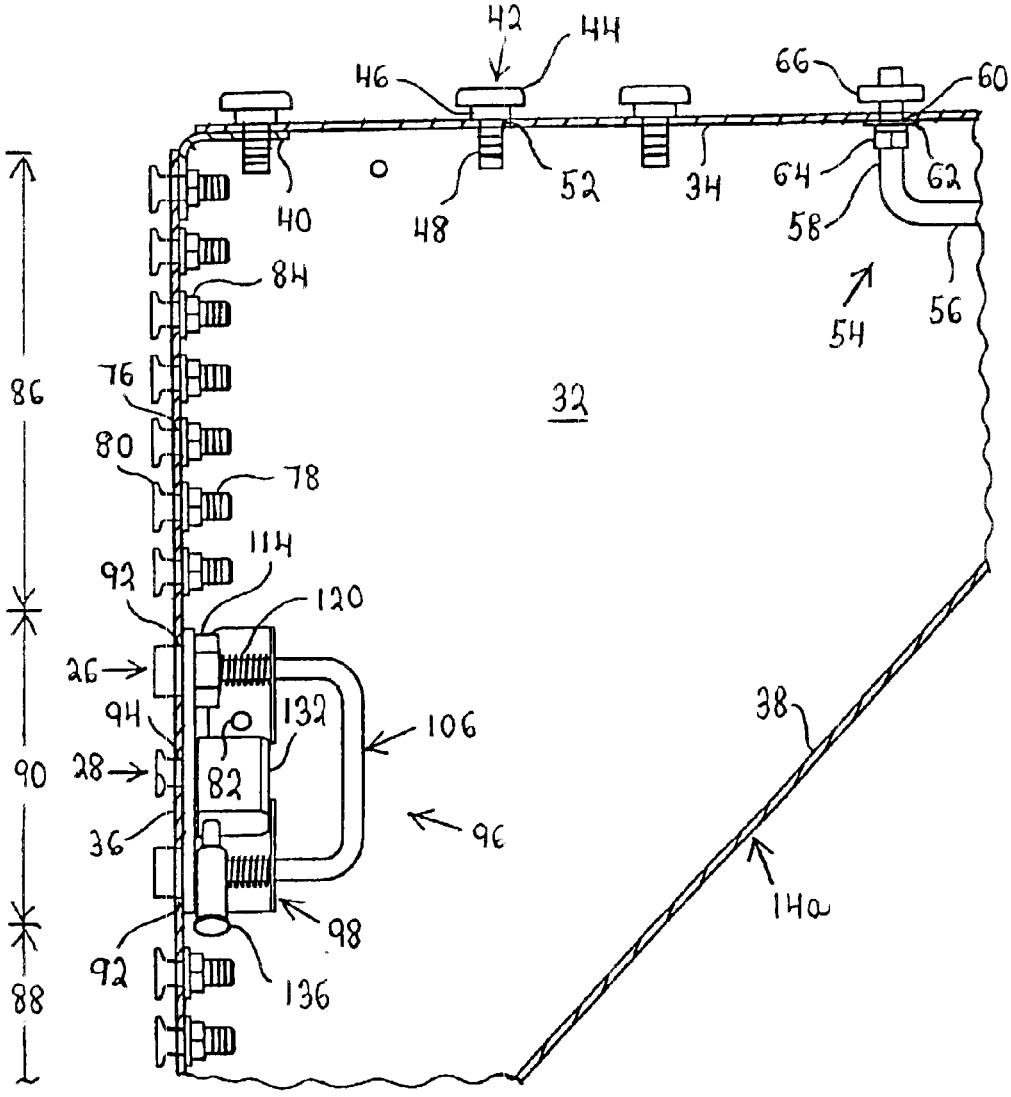
FIG. 3 is an enlarged side view of the mounting bracket of FIG. 2 with flanges constituting part of the mounting bracket in section.

Referring to FIG. 3 together with FIGS. 1 and 2, several guide members 42 are fixed to the flange 34. Each of the guide members 42 comprises an annular section 44 of larger diameter and an annular section 46 of smaller diameter. The larger annular sections 44 function as guide elements while the smaller annular sections 46 rest on the upper surface of the flange 34 and serve as spacing elements to hold the respective guide elements 44 away from the flange 34.

Fasteners are provided to hold the guide members 42 on the flange 34, and the fasteners are here in the form of bolts each having a threaded shaft 48 and a head 50 at one end of the respective shaft 48. The spacing element 46 of each guide member 42 is formed with an axial passage which is aligned with a hole 52 in the flange 34. On the other hand, the guide element 44 of each guide member 42 is formed with a central recess which opens to the axial passage in the respective spacing element 46. Each of the bolts 48,50 is arranged with the bolt head 50 in the recess of a guide element 44 and with the shaft 48 extending through the respective spacing element 46 and through the respective hole 52. The shaft 48 of each bolt 48,50 projects below the flange 34, and the bolts 48,50 can be tightened by means of non-illustrated flange nuts mounted on the projecting portions of the bolt shafts 48.

A locking unit 54 is also mounted on the flange 34 and includes a rod-like, L-shaped locking handle having a longer leg 56 and a shorter leg 58. The longer handle leg 56 is located beneath the flange 34, and the shorter handle leg 58 extends upward from the longer leg 56. The flange 34 is formed with a hole 60, and the shorter handle leg 58 has a threaded part which passes through the hole 60 and projects above and below the flange 34. A washer 62 is mounted on the threaded part of the shorter leg 58 underneath the flange 34 and is urged against the latter by a nut 64 threaded onto the shorter leg 58 below the washer 62.

A rectangular locking plate or sheet 66 is disposed on the shorter leg 58 above the flange 34, and the locking plate 66 has a threaded central opening which allows the locking plate 66 to be screwed onto the threaded part of the shorter leg 58. The locking plate 66, which is here situated intermediate two of the guide members 42, is spaced from the flange 34 so that a segment of the shorter handle leg 58 is exposed between the locking plate 66 and the flange 34.

Figure 4:
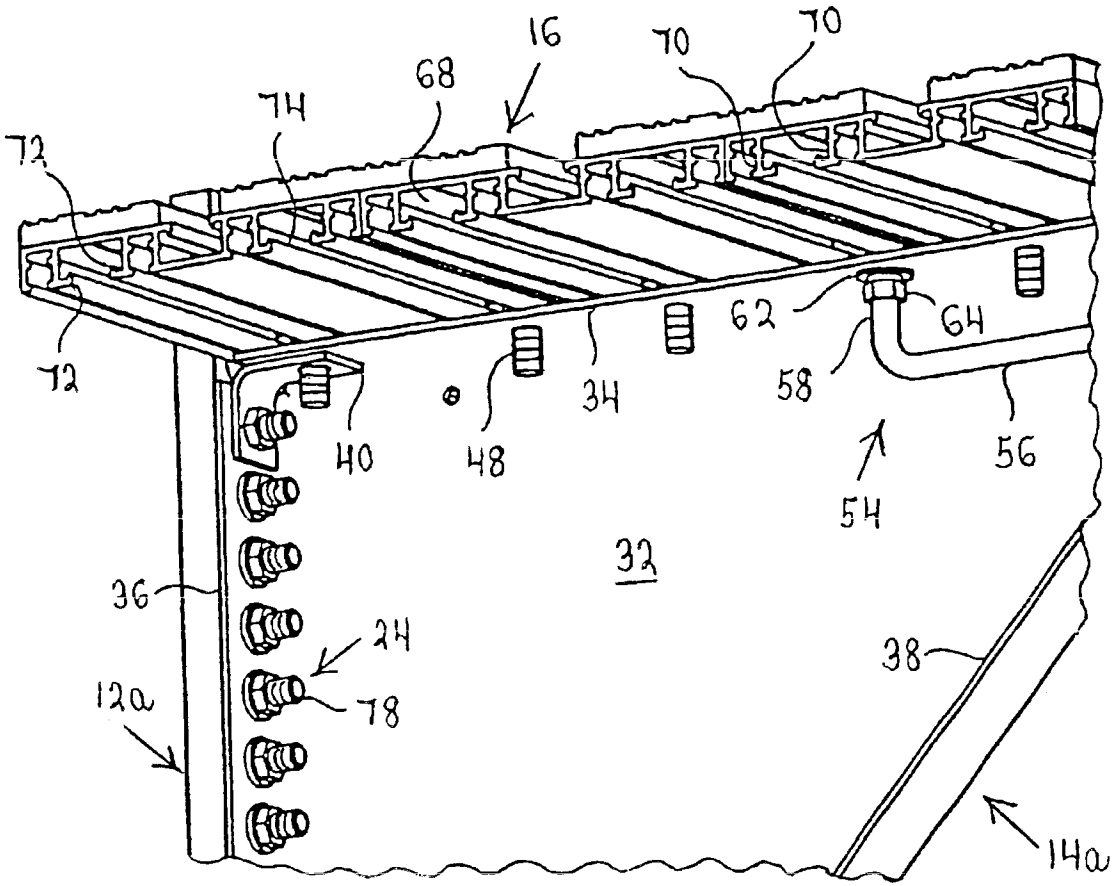
FIG. 4 is an enlarged fragmentary view, as seen in the direction of the arrow A of FIG. 1, of the mounting bracket of FIG. 2 supporting the shelf of FIG. 1.

As seen in FIGS. 1 and 4, the underside of the shelf 16 is formed with several channels 68 which extend widthwise of the shelf 16, that is, in a direction from one of the mounting brackets 14*a*, 14*b* to the other. Each of the channels 68 is open at both ends thereof, and one of the channels 68 is arranged to receive the locking plate 66 while each of the other channels 68 is arranged to receive one of the guide elements 44.

Each of the channels 68 is laterally bounded by two strips 70 which project from the underside of the shelf 16 and extend longitudinally of the respective channel 68. A rail 72 is located at the lower edge of each strip 70 and runs the length of the strip 70. The rails 72 on the two strips 70 bounding a channel 68 project towards but terminate short of one another so as to define a gap 74 which extends longitudinally of the corresponding channel 68. The widths of the gaps 74 exceed the diameters of the shorter handle leg 58 and the shafts 48 of the bolts 48,50.

To mount the shelf 16 on the mounting bracket 14*a*, the shelf 16 is positioned to one side of the bracket 14*a* with the open ends of the channels 68 in register with the guide elements 44 and the locking plate 66, respectively. The locking plate 66 is positioned as in FIG. 2 with the longer edges thereof facing the neighboring guide elements 44. The shelf 16 is now shifted towards the mounting bracket 14*a* so that the locking plate 66 and each of the guide elements 44 enters a respective channel 68 while each of the bolt shafts 48, as well as the exposed locking handle segment between the plate 66 and the flange 34, enters a respective gap 74.

When the locking plate 66 is in the respective channel 68, the longer edges of the locking plate 66 face the strips 70 laterally bounding this channel 68. The width of the locking plate 66 is such that there is very little clearance between the longer edges of the locking plate 66 and the adjoining strips 70. Accordingly, the locking plate 66 is prevented from rotating in the respective channel 68. Thus, when the handle 56,58 is rotated, the locking plate 66 moves up to a raised position or down to a lowered position depending upon the direction of rotation of the handle 56,58. The locking plate 66 is in the raised position upon entering the respective channel 68 and, in this position, sits above and is free to move along the adjoining rails 72.

Once the shelf 16 has been properly positioned on the mounting bracket 14*a*, the handle 56,58 is rotated in a direction such that the locking plate 66 moves downward. The locking plate 66 is urged against the adjoining rails 72 which are clamped between the underside of the locking plate 66 and the top surface of the flange 34. As a result, the shelf 16 is locked in position.

As shown in FIG. 3, the flange 36 of the triangular plate 32 is provided with a series of threaded holes or openings 76 which define respective receiving positions for the studs 24. Each of the studs 24 includes a circular shaft 78 and an enlarged circular head 80 fixed to one end of the shaft 78. The heads 80 fit into the apertures 22 of the track 12*a* with clearance and, after insertion in the apertures 22, can slide along the dovetailed groove 18 into alignment with the necks 30. The necks 30 are narrower than the heads 80 thereby preventing the studs 24 from being pulled out of the track 12*a* when the heads 80 are aligned with the necks 30. On the other hand, the shafts 78 of the studs 24 fit in the necks 30 with clearance.

Each of the shafts 78 of the studs 24 has a threaded part which is screwed into the respective hole 76 in such a manner that the heads 80 are located to the side of the flange 36 facing away from the triangular plate 32 of the mounting bracket 14*a*. The heads 80 are spaced from the flange 36 so that a segment of each shaft 78 is exposed between the flange 36 and the respective head 80. The shafts 78 project to the side of the flange 36 facing the triangular plate 32, and a flange nut 84 is threaded onto each shaft 78. The flange nuts 84 are urged against the flange 36 thereby preventing movement of the studs 24.

The holes 76 are arranged in a straight row running longitudinally of the flange 36. However, the holes 76 are divided into two groups. One group of holes 76 extends along a section 86 of the flange 36 while the other group extends along a section 88 of the flange 36, and the sections 86 and 88 are separated from each other by another section 90 of the flange 36. Within each group, the center-to-center spacing of neighboring holes 76 is uniform. Furthermore, the center-to-center spacing of neighboring holes 76 in one group is the same as the center-to-center spacing of neighboring holes 76 in the other group. In addition, the center-to-center spacing of the two closest holes 76 of the two groups is an integral multiple of the center-to-center spacing of neighboring holes 76 of a group. The center-to-center spacing of neighboring holes 76 in each group equals the center-to-center spacing of neighboring apertures 22 in the track 12*a*.

The arrangement and spacing of the studs 24 is the same as that of the holes 76.

The section 90 of the flange 36, which is located between the two groups of holes 76, is provided with two additional holes 92 having a center-to-center spacing which is the same as, or is an integral multiple of, the center-to-center spacing of neighboring holes 76 of a group. The additional holes 92 are situated in the row defined by the holes 76, and the center-to-center spacing of a hole 92 and any hole 76 is different from the center-to-center spacing of neighboring holes 76 of a group and different from an integral multiple of the latter spacing. Thus, the center-to-center spacing of a hole 92 and any given hole 76 equals a fraction of the center-to-center spacing of neighboring holes 76 of a group, or equals the center-to-center spacing of neighboring holes 76 of a group plus a fraction of this spacing, or equals an integral multiple of the center-to-center spacing of neighboring holes 76 of a group plus a fraction of such spacing. Preferably, as is assumed here, the center-to-center spacing of a hole 92 and a hole 76 equals one-half of the center-to-center spacing of neighboring holes 76 of a group, or equals the center-to-center spacing of neighboring holes 76 of a group plus one-half of such spacing, or equals an integral multiple of the center-to-center spacing of neighboring holes 76 of a group plus one-half of this spacing. Each of the additional holes 92 defines a receiving position for one of the plugs 26 designed to inhibit movement of the mounting bracket 14*a* along the track 12*a*, and the additional holes 92 are dimensioned to receive the plugs 26 with clearance.

Another hole 94 is formed in the flange 36 between the additional holes 92. Similarly to the additional holes 92, the hole 94 is disposed in the row defined by the holes 76. The center-to-center spacing of the hole 94 and any given one of the holes 76 equals the center-to-center spacing of neighboring holes 76 of a group or equals an integral multiple of this spacing. Hence, the center-to-center spacing of the hole 94 and each additional hole 92 is different from the center-to-center spacing of neighboring holes 76 of a group and different from an integral multiple of the latter spacing. The hole 94 defines a receiving position for the locking member 28 designed to inhibit withdrawal of the plugs 26 from the track 12*a*, and the hole 94 is dimensioned to receive the locking member 28 with clearance.

Figure 5:
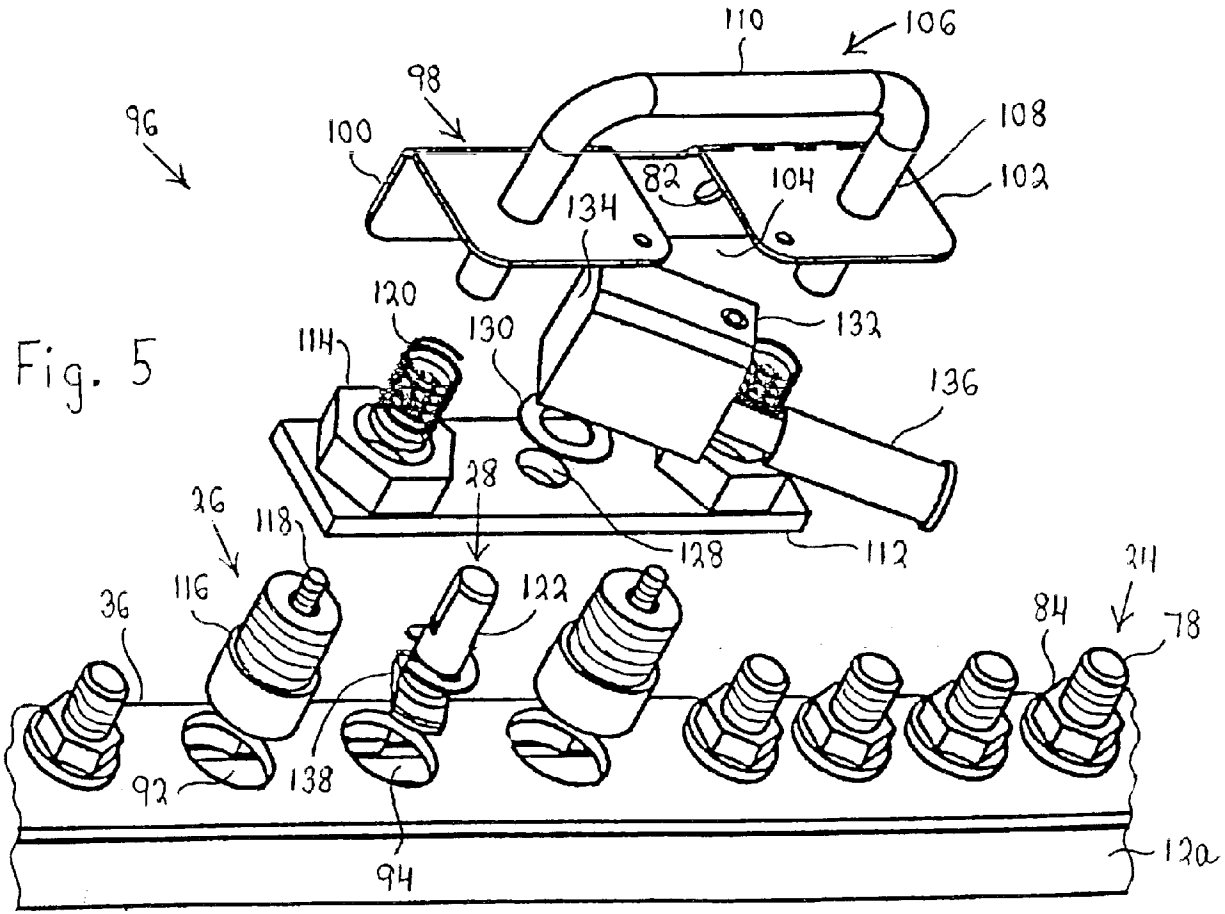
FIG. 5 is an enlarged exploded perspective view of the arresting and locking unit of FIG. 2 as well as an enlarged fragmentary perspective view of the track of FIG. 2 and a flange forming part of the mounting bracket of FIG. 2.

The plugs 26 and the locking member 28 constitute part of an arresting and locking unit 96 which is designed to hold the mounting bracket 14*a* in position on the track 12*a*. Considering FIG. 5 in conjunction with FIGS. 2 and 3, the arresting and locking unit 96 comprises a support 98 which includes a strip-like portion 100 and two tabs 102 projecting from one of the longitudinal edges of the strip-like portion 100 at right angles to the strip-like portion 100. The strip-like portion 100 is provided with a pair of longitudinally spaced holes 82 which are in register with respective holes in the triangular plate 32 of the mounting bracket 14*a*. The holes 82 and the corresponding holes in the triangular plate 32 receive non-illustrated fasteners, e.g., bolts, which serve to fix the arresting and locking unit 96 to the triangular plate 32. The arresting and locking unit 96 is mounted on the surface of the triangular plate 32 which faces the flanges 34,36,38, and the arresting and locking unit 96 is positioned so that the plugs 26 are aligned with respective ones of the holes 92 in the flange 36 and the locking member 28 is aligned with the hole 94 in the flange 36.

The strip-like portion 100 lies against the triangular plate 32 whereas the tabs 102 are perpendicular to the tabs 102 and parallel to the flange 36. The tabs 102 are spaced from one another longitudinally of the strip-like portion 100 and define a gap 104. A U-shaped handle 106 is fixed to the support 98 and has two parallel legs 108 which are connected to one another by a crosspiece 110. Each of the legs 108 passes through an opening in a respective tab 102 and is slidable in such opening relative to the tab 102. The handle 106 is arranged such that the crosspiece 110 is located to the side of the tabs 102 facing away from the flange 36 while the free ends of the legs 108 are located to the side of the tabs 102 directed towards the flange 36. The legs 108 are hollow and the free ends of the legs 108 are open.

The arresting and locking unit 96 further comprises a rectangular carrier plate 112 which is provided with an opening at either longitudinal end thereof. The carrier plate 112 is parallel to the flange 36 and the tabs 102 and has a major surface which faces the tabs 102. A pair of jam nuts 114 sits against this major surface of the carrier plate 112, and each of the jam nuts 114 has an opening in register with a respective opening in the carrier plate 112.

Each of the plugs 26 has an annular section of larger diameter and a threaded annular section of smaller diameter, and the smaller section is located between the larger section and a respective one of the tabs 102. The two sections of each plug 26 cooperate to define a circular shoulder 116. A shaft 118 extends axially through each of the plugs 26, and each shaft 118 has an end portion which projects from the smaller annular section of the respective plug 26 and another end portion which is disposed within the respective plug 26. The shafts 118 can, for instance, constitute the shafts of flathead screws. The smaller section of each plug 26 is received by a respective opening in the carrier plate 112 and is screwed into the adjoining jam nut 114. The plugs 26, which are fast with the carrier plate 112, are arranged in such a manner that the shoulders 116 abut the major surface of the carrier plate 112 facing away from the jam nuts 114. Furthermore, the plugs 26 and the shafts 118 are designed so that at least the projecting end portions of the shafts 118 protrude from the jam nuts 114. Each of the projecting end portions of the shafts 118 extends into a respective leg 108 of the handle 106, and the shafts 118 are connected to the legs 108. For example, the legs 108 can be internally threaded and the shafts 118 can be screwed into the legs 108.

A spring 120 surrounds each of the legs 108 of the handle 106. Each of the springs 120 bears against the smaller section of the respective plug 26 and against the adjacent tab 102 of the support 98. When the springs 120 are relaxed or unstressed, the plugs 26 are in an operative extended position in which the plugs 26 project to the side of the flange 36 facing away from the tabs 102. Pulling the crosspiece 110 of the handle 106 away from the flange 36 causes the springs 120 to compress and the plugs 26 to move towards an inoperative retracted position in which the plugs 26 no longer project to the side of the flange 36 facing away from the tabs 102. In the compressed condition of the springs 120, the springs 120 urge the plugs 26 away from the tabs 102.

The locking member 28 includes a splined shaft 122 of generally circular cross section and a cam 138 on one end of the shaft 122. The carrier plate 112 has a circular central opening 128 between the jam nuts 114, and a spring washer 130 is situated next to the major surface of the carrier plate 112 which faces the jam nuts 114. The spring washer 130 has an opening in register with the central opening 128, and the shaft 122 extends through the central opening 128 and the registering opening of the spring washer 130 into a generally rectangular block 132. The block 132 is located on the same side of the carrier plate 112 as the jam nuts 114 while the cam is located on the opposite side of the carrier plate 112.

The shaft 122 of the locking member 28 is rotatable in the central opening 128 of the carrier plate 112 and defines an axis of rotation for the block 132. This axis of rotation is perpendicular to the carrier plate 112. The block 132 has two opposed, flat end faces 134 (only one visible in the drawings) which are perpendicular to the plane of the carrier plate 112, and a handle 136 projects from one of the end faces 134. The handle 136 can be used to rotate the block 132 between the illustrated locked position and an unlocked or released position in which the end face 134 remote from the handle 136 faces and is parallel to the strip-like portion 100 of the support 98. In the released position, the block 132 is receivable in the gap 104 of the support 98.

Although the locking member 28 and the block 132 are rotatable relative to the carrier plate 112, the locking member 28 and the block 132 are prevented from moving relative to the carrier plate 112 in a direction normal to the plane of the plate 112. The arrangement is such that the plugs 26, the locking member 28, the handle 106, the carrier plate 112 and the block 132 move as a unit. When the handle 106 is pulled, the unit including the plugs 26, the locking member 28, the carrier plate 112 and the block 132 moves towards the tabs 102. Upon release of the handle 106, the unit moves away from the tabs 102 under the urging of the springs 120.

In the uncompressed condition of the springs 120, the springs 120 urge the carrier plate 112 against the flange 36. In this position of the carrier plate 112, the block 132 is held away from the tabs 102 so that the block 132 is free to rotate. Pulling the handle 106 causes the springs 120 to compress and the block 132 to move towards the tabs 102. If the block 132 is not in the released position, the block 132 will eventually abut the tabs 102 thereby preventing further displacement of the block 132. On the other hand, when the block 132 is in its released position, the block 132 can enter the gap 104 between the tabs 102 as the block 132 is drawn towards the tabs 102 thus allowing the block 132 to move alongside the tabs 102. Once the block 132 is in the gap 104, the block 132 is unable to rotate.

When the springs 120 are uncompressed, the cam 138 of the locking member 28 is in an operative extended position in which the cam 138 is situated to the side of the flange 36 facing away from the tabs 102 and is spaced from such side by the same distance, or about the same distance, as the heads 80 of the studs 24. Pulling the crosspiece 110 of the handle 106 away from the flange 36 causes the cam 138 to move towards an inoperative retracted position in which the cam 138 no longer projects to the side of the flange 36 facing away from the tabs 102.

The cam 138 of the locking member 28 is in the form of an approximately rectangular plate having a convex major surface which faces the shaft 122 of the locking member 28, and the shaft 122 is connected to the central portion of such major surface. The width of the cam 138 is less than the width of the necks 30 in the track 12*a* so that the cam 138 can pass through a neck 30 into the dovetailed groove 18 of the track 12*a*. Following insertion of the cam 138 in the dovetailed groove 18, the cam 138 can be wedged in the groove 18 by rotating the cam 138.

Assuming that the track 12*a* has been mounted on a wall in a vertical orientation, one manner of operation of the support system 10 is as follows:

The mounting bracket 14*a* is oriented with the flange 34 running horizontally and the flange 36 extending vertically downward from the flange 34. The flange 36 is positioned parallel or approximately parallel to the track 12*a* at a spacing therefrom with the flange 34 at the desired height for the shelf 16 and with the heads 80 of the studs 24 facing respective apertures 22 in the track 12*a*. The springs 120 of the arresting and locking unit 96 are in their uncompressed condition, and the plugs 26 and cam 138 are in their operative extended positions.

The flange 36 is now pushed against the anchoring surface 20 of the track 12*a*. This causes the heads 80 of the studs 24 to pass through the registering apertures 22 into the groove 18.

Since the heads 80 of the studs 24 are in register with the apertures 22, and since the center-to-center spacing of a hole 92 and any stud hole 76 of the flange 36 is different from the center-to-center spacing of neighboring apertures 22 and different from an integral multiple of the latter spacing, the holes 92 and plugs 26 are out of register with the apertures 22. Specifically, inasmuch as the spacing of a hole 92 and a stud hole 76 is here assumed to equal one-half of the center-to-center spacing of neighboring holes 76 of a group, or to equal the center-to-center spacing of neighboring holes 76 of a group plus one-half of such spacing, or to equal an integral multiple of the center-to-center spacing of neighboring holes 76 of a group plus one-half of this spacing, the holes 92 and plugs 26 are aligned with the necks 30 of the track 12*a*. Hence, as the flange 36 is moved towards the anchoring surface 20 of the track 12*a*, the plugs 26 come into contact with the anchoring surface 20.

As noted above, the plugs 26 are in their operative extended positions before the flange 36 is pushed against the anchoring surface 20. The arrangement is such that, when the flange 36 is moved towards the anchoring surface 20, the plugs 26 contact the anchoring surface 20 before the heads 80 of the studs 24 reach the groove 18 of the track 12*a*. Thus, as the flange 36 approaches the anchoring surface 20, the plugs 26 move towards their inoperative retracted positions and the springs 120 are compressed. The handle 106 of the arresting and locking unit 96 is pushed away from the flange 36 in response to retraction of the plugs 26.

The hole 94 of the flange 36 and each stud hole 76 have a center-to-center spacing equal to the center-to-center spacing of neighboring apertures 22 or equal to an integral multiple of the latter spacing. Accordingly, the hole 94 and the cam 138 of the locking member 28 are in alignment with one of the apertures 22.

Prior to moving the flange 36 towards the anchoring surface 20 of the track 12*a*, the block 132 is rotated to the unlocked position in which the end face 134 remote from the handle 136 faces and is parallel to the strip-like portion 100 of the support 98. In the unlocked position of the block 132, the orientation of the cam 138 is such that the cam 138 is able to enter a neck 30 of the track 12*a*. Thus, the length dimension of the cam 138 runs in the same direction as the length dimension of the track 12*a* when the block 132 is in the unlocked position.

As mentioned previously, the cam 138 is in its operative extended position before the flange 36 is pushed against the anchoring surface 20 of the track 12*a*. Due to the fact that the cam 138 moves as a unit with the plugs 26, the cam 138 is displaced towards its inoperative retracted position as the plugs 26 retract in response to movement of the flange 36 towards the anchoring surface 20.

The block 132 of the arresting and locking unit 96 likewise moves as a unit with the plugs 26 and shifts away from the flange 36 during movement of the latter into abutment with the anchoring surface 20. As the block 132 moves away from the flange 36, the block 132 enters the gap 104 between the tabs 102 of the arresting and locking unit 96. As a result, the block 132 is held against rotation.

With the flange 36 abutting the anchoring surface 20 of the track 12*a* and the springs 120 in compression, the mounting bracket 14*a* and the arresting and locking unit 96 are shifted longitudinally of the track 12*a*. The mounting bracket 14*a* and the arresting and locking unit 96 are moved through a distance equal to one-half the center-to-center spacing of neighboring apertures 22 of the track 12*a* in order to bring the studs 24 into register with respective necks 30 of the track 12*a*. Once the studs 24 register with the necks 30, the mounting bracket 14*a* is anchored to the track 12*a* by way of the studs 24 because the heads 80 of the studs 24 cannot pass through the necks 30 thereby preventing the mounting bracket 14*a* from being pulled out of the track 12*a*.

When the studs 24 arrive at the respective necks 30, the holes 92 of the flange 36 come into alignment with respective apertures 22 of the track 12*a*. This is so because the necks 30 are located midway between neighboring apertures 22 and, prior to shifting of the mounting bracket 14*a* and the arresting and locking unit 96, the holes 92 were in register with the necks 30. On the other hand, the hole 94 of the flange 36 comes into alignment with a neck 30 upon arrival of the studs 24 at the respective necks 30. In this regard, it will be recalled that the hole 94 was in register with an aperture 22 before the mounting bracket 14*a* and the arresting and locking unit 96 were shifted.

Once the holes 92 of the flange 36 are aligned with respective apertures 22 of the track 12*a*, the plugs 26 are likewise aligned with such apertures 22. The compressed springs 120 thereupon urge the plugs 26 into the respective apertures 22 while the cam 138, which is in register with a neck 30 of the track 12*a*, passes through this neck 30 into the groove 18 of the track 12*a*. Furthermore, the handle 106 and the block 132 shift back towards the flange 36 and, in the process, the block 132 moves out of the gap 104 and away from the tabs 102.

The plugs 26 and the cam 138 are now in their operative extended positions whereas the springs 120 are in their relaxed or unstressed state.

When the plugs 26 enter the respective apertures 22, the plugs 26 arrest the mounting bracket 14*a* against movement relative to the track 12*a* longitudinally and transversely of the track 12*a*. Following the introduction of the plugs 26 into the respective apertures 22, the block 132 is rotated to its locked position by way of the handle 136. This causes the cam 138 to frictionally engages the track 12*a* thereby locking the plugs 26 in the respective apertures 22 and preventing the plugs 26 from being pulled out of the apertures 22 during an impact.

After the mounting bracket 14*a* has been secured to the track 12*a*, the shelf 16 can be mounted on the bracket 14*a* as explained earlier.

If it is desired to release the mounting bracket 14*a* from the track 12*a*, the block 132 is rotated to its released position. The handle 106 is thereupon pulled to move the plugs 26 and the cam 138 to their inoperative retracted positions. While exerting a pull on the handle 106, the mounting bracket 14*a* and the arresting and locking unit 96 are shifted longitudinally of the track 12*a* through a distance equal to one-half of the center-to-center spacing of neighboring apertures 22 of the track 12*a*. After the mounting bracket 14*a* and the arresting and locking unit 96 have been shifted through such distance, the bracket 14*a* can be pulled away from the track 12*a*.

FIGS. 6–12 illustrate another embodiment of a support system in accordance with the invention. In FIGS. 6–12, the same reference numerals as in FIGS. 1–5, plus 200, are used to identify similar elements.

The support system of FIGS. 6–12 differs from the support system 10 of FIGS. 1–5 primarily in that the shelf locking unit 54 of FIGS. 1–5 has been replaced by two locking units 254*a* and 254*b* which are designed differently than the locking unit 54. Furthermore, the guide elements 42 of FIGS. 1–5 have been eliminated in FIGS. 6–12. In addition, while the bracket 14*a* in the support system 10 of FIGS. 1–5 has more than one pair of studs 24 to either side of the arresting and locking unit 96, the bracket 214*a* in the support system of FIGS. 6–12 has only a single pair of studs 224 to either side of the arresting and locking unit 296.

The locking units 254*a*, 254*b* of FIGS. 6–12 are identical and will be described with reference to the locking unit 254*a*.

Figure 6:
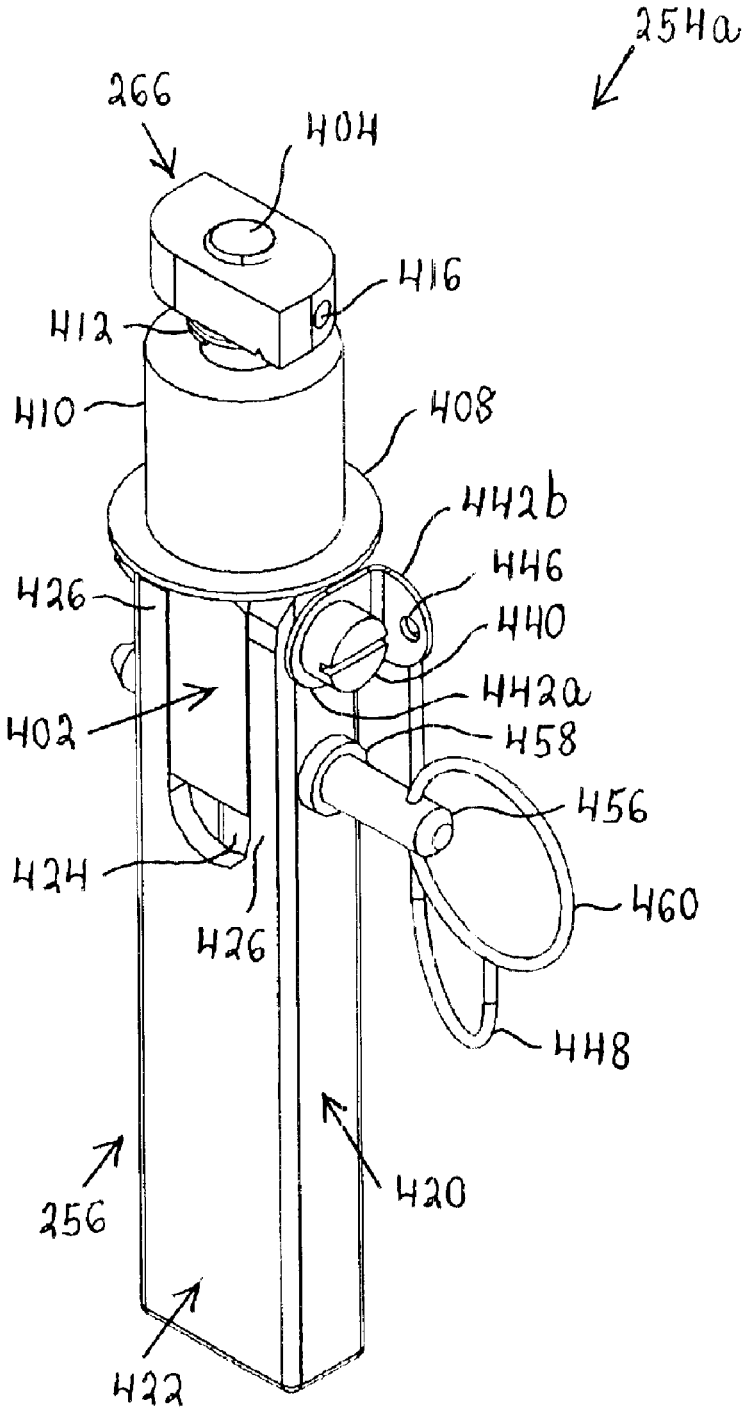
FIG. 6 is a perspective view of another embodiment of a mounting bracket and another embodiment of a locking unit for the shelf of FIG. 1, the locking unit including a quick release pin which is connected to a bracket of the locking unit by a lanyard.
Figure 7:
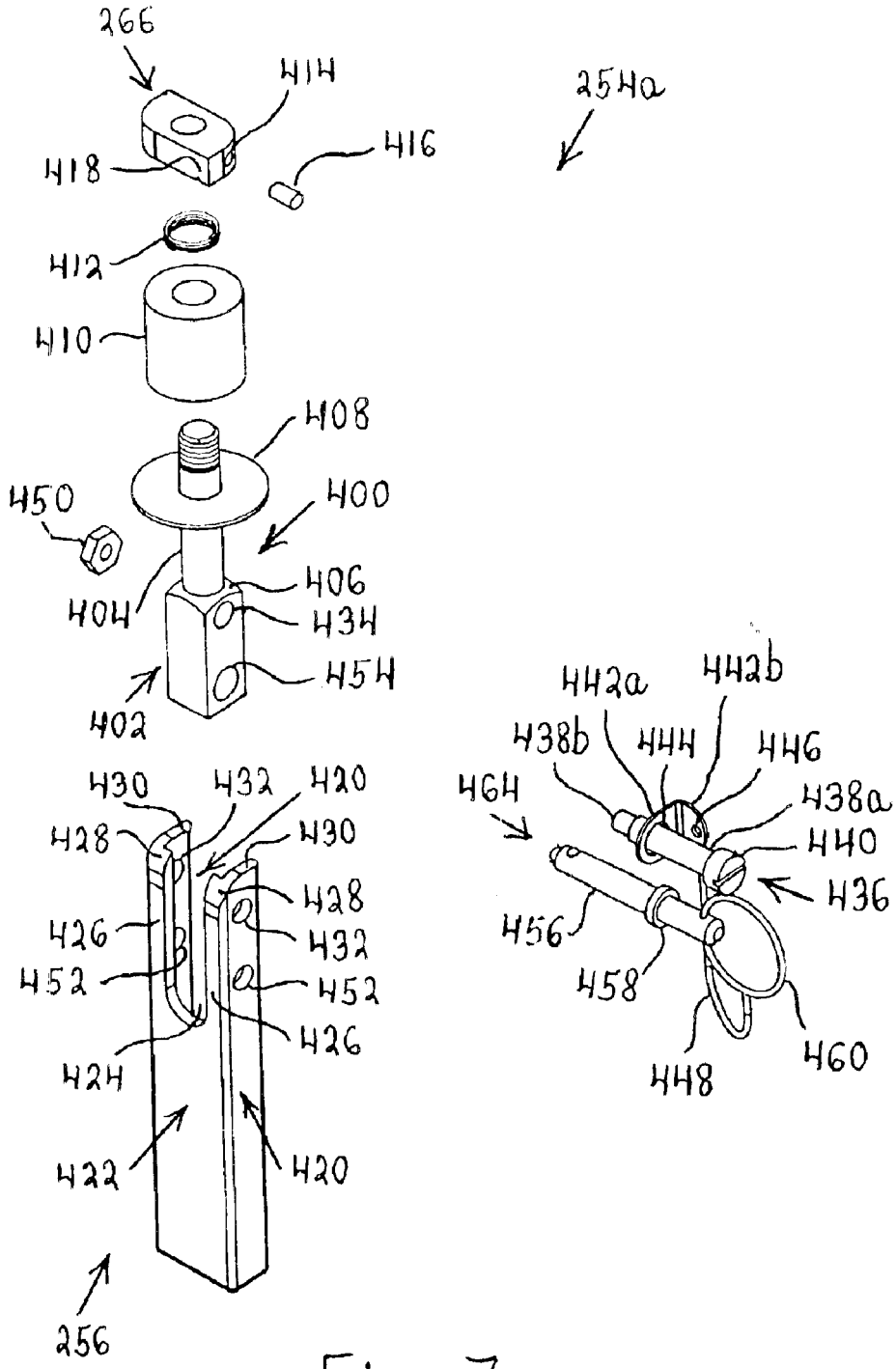
FIG. 7 is an exploded perspective view of the shelf locking unit of FIG. 6.

Considering FIGS. 6 and 7, the locking unit 254*a* comprises a draw bolt 400 which includes a generally rectangular block 402 and a shaft 404 of circular cross section extending from one end of the block 402. The end of the shaft 404 remote from the block 402 is threaded. A shoulder or abutment 406 is defined on the block 402 at the junction of the block 402 and the shaft 404, and a washer 408 sits on the shaft 404 and lies against the shoulder 406.

A tubular element 410 serving as a spacer also sits on the shaft 404 and bears against the side of the washer 408 remote from the block 402. Furthermore, a coil spring 412 is mounted on the shaft 404 and lies against the end of the spacer 410 remote from the washer 408.

A holding nut 266 is screwed onto the threaded end of the shaft 404, and the coil spring 412 bears against the nut 266. The holding nut 266 has a threaded passage 414 which extends laterally of the nut 266 and is perpendicular to the shaft 404, and the passage 414 opens to the external surface of the nut 266 and to the shaft 404. The passage 414 is designed to receive a set screw 416 which functions to secure the holding nut 266 on the shaft 404.

The holding nut 266 resembles a rectangular block with two rounded corners. The surface of the holding nut 266 which faces the coil spring 412 is formed with two grooves 418 (only one is visible in FIGS. 6 and 7) which are parallel to one another and have the shape of an inverted V. The grooves 418 run transverse to the length of the holding nut 266, and the spacing between the grooves 418 exceeds the diameter of the coil spring 412 which is disposed between the grooves 418.

The locking unit 254*a* further comprises an elongated channel-shaped handle 256. The handle 256 includes two spaced legs 420 and a crosspiece 422 which bridges the legs 420. The legs 420 extend longitudinally of the handle 256 and are parallel to one another, and the gap between the legs 420 is sized to receive the block 402 of the draw bolt 400 with clearance.

The handle 256 has an end which is arranged to face the washer 408, and the crosspiece 422 is provided with a U-shaped cutout 424 adjacent to such end of the handle 256. The cutout 424 is laterally bounded by two strip-shaped sections 426 of the crosspiece 422, and each of the strip-shaped sections 426, as well as each of the legs 420, has an end face which is directed towards the washer 408. A convex cam surface 428 is formed on such end face of each strip-shaped section 426 and extends partway along the corresponding end face of the adjoining leg 420. Each of the cam surfaces 428 merges into a flat surface 430 provided on the associated end face of the adjacent leg 420.

The gap between the strip-shaped sections 426 of the crosspiece 422 is narrower than the block 402 of the draw bolt 400 so that the block 402 is unable to pass through this gap.

Each of the legs 420 of the handle 256 has an opening 432 near the end of the handle 256 which faces the washer 408. The openings 432 face one another and the axes of the openings 432 lie on a common line. The block 402 of the draw bolt 400 is provided with a passage 434 which is aligned with the openings 432 when the block 402 is appropriately positioned between the legs 420.

The openings 432 and the passage 434 are designed to receive a shoulder screw 436 which includes a shaft having a section 438*a* of larger diameter and a threaded section 438*b* of smaller diameter. The shoulder screw 436 further includes a round slotted head 440 which is mounted on the end of the larger shaft section 438*a* remote from the smaller shaft section 438*b*.

The locking unit 254*a* additionally comprises a bracket having a longer arm 442*a* and a shorter arm 442*b* which are perpendicular to one another. The longer arm 442*a* is formed with a circular opening 444 having a diameter larger than that of the larger shaft section 438*a* of the shoulder screw 436 but smaller than that of the head 440. The shorter arm 442*b* is likewise formed with an opening 446, and the opening 446 can be used to attach one end of a lanyard 448 to the bracket 442*a*, 442*b*.

When the passage 434 in the block 402 of the draw bolt 400 is aligned with the openings 432 in the legs 420 of the handle 256, the shoulder screw 436 can be inserted in the openings 432 and the passage 434. Prior to insertion of the shoulder screw 436 in the openings 432 and the passage 434, the shaft 438*a*, 438*b* of the shoulder screw 436 is passed through the opening 444 of the longer bracket arm 442*a*. The shaft 438*a*, 438*b* is then successively passed through the opening 432 in one of the handle legs 420, through the passage 434 of the block 402 and through the opening 432 in the other of the handle legs 420. The shoulder screw 436 is positioned with the longer bracket arm 442*a* abutting the block 402 and the head 440 of the shoulder screw 436 abutting the longer bracket arm 442*a*. In this position, the head 440 of the shoulder screw 436 is located to one side of the block 402 and the threaded shaft section 438*b* of the shoulder screw 436 projects to the opposite side of the block 402. A locknut 450 is screwed onto the threaded shaft section 438*b* to secure the shoulder screw 436 to the block 402.

The shoulder screw 436 functions as a pivot and allows the handle 256 to pivot relative to the draw bolt 400 between a raised or unlocked position and a lowered or locked position.

Each of the handle legs 420 has an additional opening 452 between the respective opening 432 and the end of the U-shaped cutout 424 of the crosspiece 422. The openings 452 face one another and the axes of the openings 452 lie on a common line. The block 402 of the draw bolt 400 is provided with a passage 454 which is aligned with the openings 452 when the block 402 is appropriately positioned between the legs 420.

The openings 452 and the passage 454 are designed to receive a quick release pin 464 having a shaft 456 which is provided with a collar 458. The collar 458 is located nearer one end of the shaft 456 than the other, and the end of the shaft 456 nearer the collar 458 carries a ring 460. The ring 460 can, for example, be anchored to the shaft 456 via a passage which is formed in the shaft 456 and receives the ring 460.

As mentioned previously, one end of the lanyard 448 is attached to the bracket 442*a*, 442*b*. The other end of the lanyard 448 is attached to the ring 460 thereby preventing loss or misplacement of the quick release pin 464 when the latter is not in use.

FIGS. 8–12 show the locking unit 254*a* mounted on the flange 234 of the mounting bracket 214*a*.

To mount the locking unit 254*a* on the flange 234, the holding nut 266 and the coil spring 412 are removed from the shaft 404 of the draw bolt 400. The shaft 404 is then passed through one of the holes 252 of the flange 234 from below so that the shaft 404 projects above the flange 234. The coil spring 412 is now placed on the upwardly projecting part of the shaft 404 and the holding nut 266 is thereupon screwed onto the threaded end of the shaft 404.

When the locking unit 254*a* is properly mounted on the flange 234, the coil spring 412 bears against the underside of the holding nut 266 and against the upper surface of the flange 234. On the other hand, the spacer 410 bears against the underside of the flange 234 and against the upper surface of the washer 408 while the handle 256 contacts the underside of the washer 408.

One manner of operation of the locking unit 254*a* is described below.

As indicated earlier, the handle 256 of the locking unit 254*a* is pivotable between a raised position and a lowered position. It is assumed that the handle 256 is initially in the raised position as illustrated in FIGS. 8 and 9.

Figure 8:
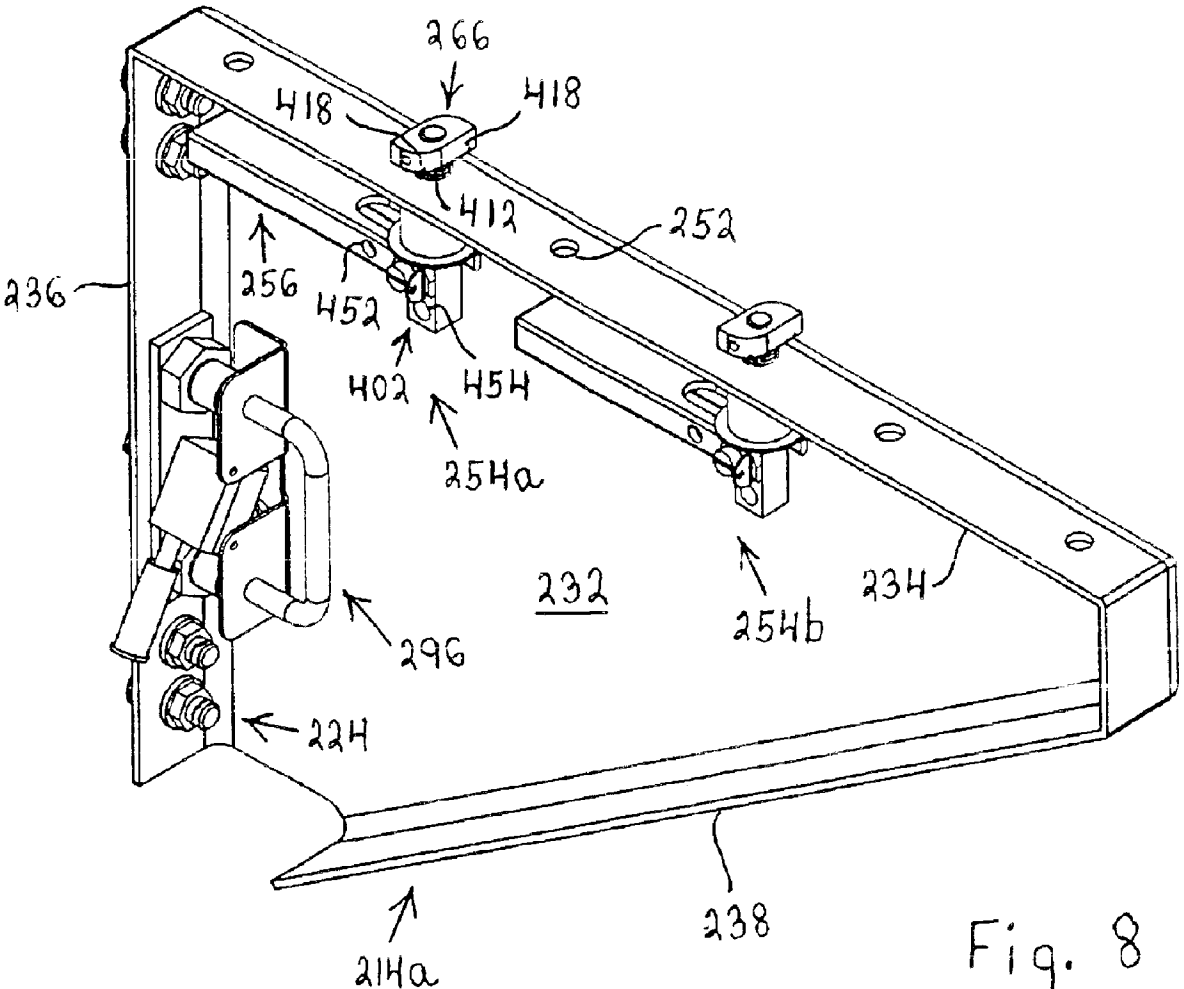
FIG. 8 is a perspective view of the mounting bracket of FIG. 6, one of the arresting and locking units of FIG. 1 and two of the shelf locking units of FIG. 6 which are shown in one of a plurality of positions but without the respective quick release pins and lanyards.
Figure 9:
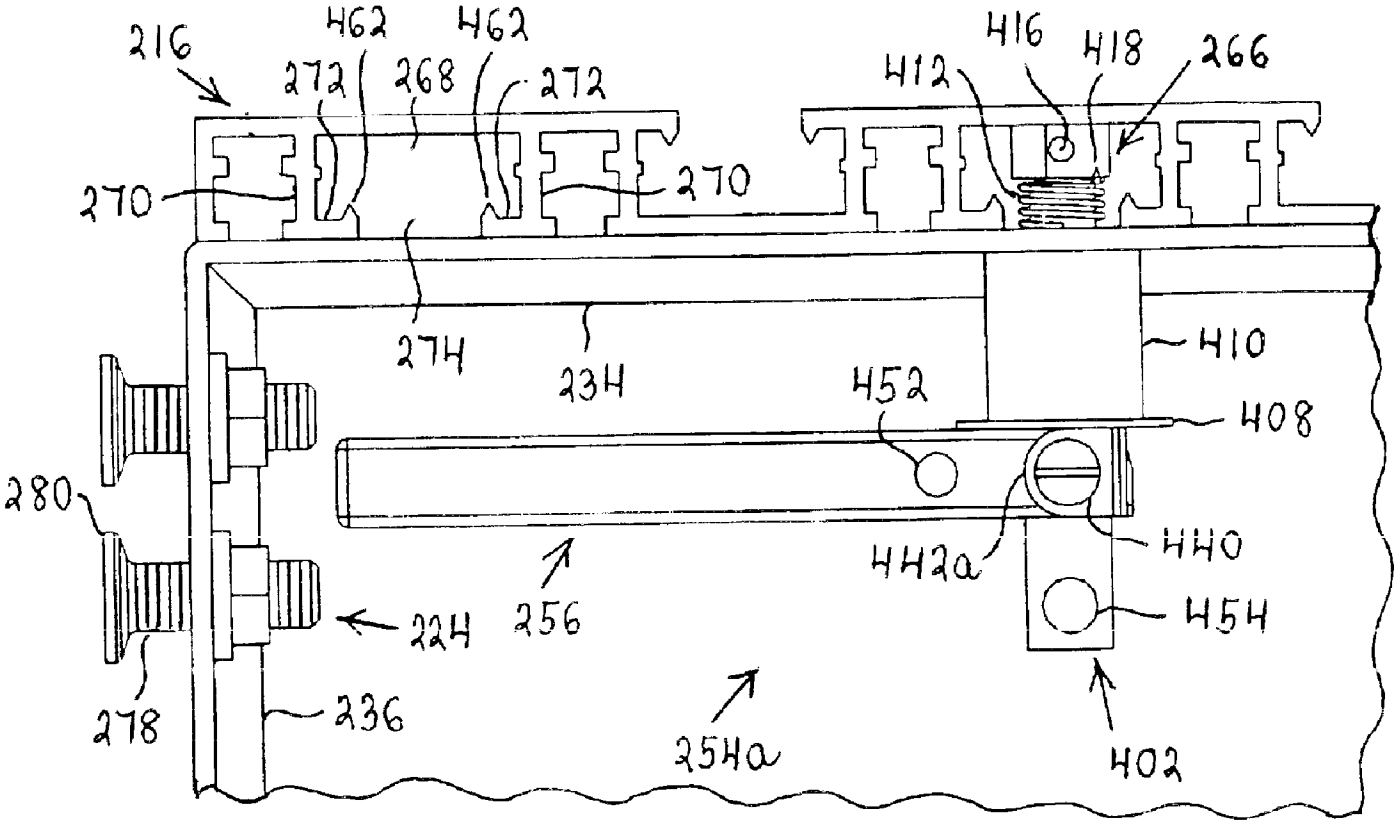
FIG. 9 is a fragmentary, partly perspective side view of the mounting bracket of FIG. 8 showing one of the two shelf locking units in the position of FIG. 8 but without the respective quick release pin and lanyard.

Considering FIGS. 8 and 9, the handle 256 is parallel to the flange 234 and perpendicular to the longitudinal axis of the draw bolt 400 and the block 402 thereof. The strip-shaped sections 426 of the crosspiece 422, as well as those transverse edges of the cam surfaces 428 nearest the openings 452 in the legs 420, are adjacent to and face the underside of the washer 408. The coil spring 412 is in an expanded condition and pushes the holding nut 266 upward and away from the flange 234. Since the holding nut 266 is fast with the draw bolt 400, the draw bolt 400 is pulled upward as is the handle 256 which is attached to the draw bolt 400. Consequently, the strip-shaped sections 426 and those transverse edges of the cam surfaces 428 nearest the openings 452 are urged against the underside of the washer 408.

When the handle 256 is parallel to the flange 234, the length of the holding nut 266 is perpendicular to the length of the flange 234. In contrast, the grooves 418 of the holding nut 266 run parallel to the length of the flange 234.

To mount the shelf 216 on the flange 234, the shelf 216 is held above the flange 234 and the holding nut 266 with the lengths of the channels 268 of the shelf 216 parallel to the length of the holding nut 266 and with the gaps 274 of the shelf 216 facing the flange 234. The shelf 216 is positioned in such a manner that an appropriate one of the gaps 274 is directly over the holding nut 266. The shelf 216 is then lowered so that the holding nut 266 passes through this gap 274 and enters the respective channel 268. When the rails 272 of the shelf 216 come to rest on the flange 234, the shelf 216 is shifted widthwise to place the shelf 216 in the desired position.

Each rail 272 has an edge which adjoins the respective gap 274, and such edge is formed with an upwardly projecting protrusion 462 having the shape of an inverted V. The protrusions 462 are designed so that at least part of a protrusion 462 can enter and fit snugly in one of the grooves 418 of the holding nut 266.

With the rails 272 of the shelf 216 resting on the flange 234 and the handle 256 is parallel to the flange 234, the holding nut 266 is located at a level above the protrusions 462 as shown in FIG. 9. The grooves 418 in the holding nut 266 extend perpendicular to the rails 272 and the protrusions 462.

The handle 256 is now rotated horizontally through 90 degrees in a counterclockwise direction as seen in FIGS. 8 and 9. This brings the handle 256 into the position of FIG. 10 where the handle 256 extends horizontally at a right angle to the flange 234.

Since the handle 256 is fast with the draw bolt 400 which, in turn, is fast with the holding nut 266, rotation of the handle 256 through 90 degrees causes the holding nut 266 to rotate by the same amount. Accordingly, the holding nut 266 rotates from a position in which the length of the holding nut 266 is perpendicular to the length of the flange 234 to a position in which the length of the holding nut 266 is parallel to the length of the flange 234. The orientation of the holding nut 266 after being rotated 90 degrees is shown in FIG. 10.

The grooves 418 of the holding nut 266, which were perpendicular to the rails 272 and the protrusions 462 prior to rotation of the holding nut 266, are now parallel to the rails 272 and the protrusions 462. Furthermore, the grooves 418 are positioned above and in alignment with the protrusions 462 which correspond to the channel 268 accommodating the holding nut 266.

Figure 10:
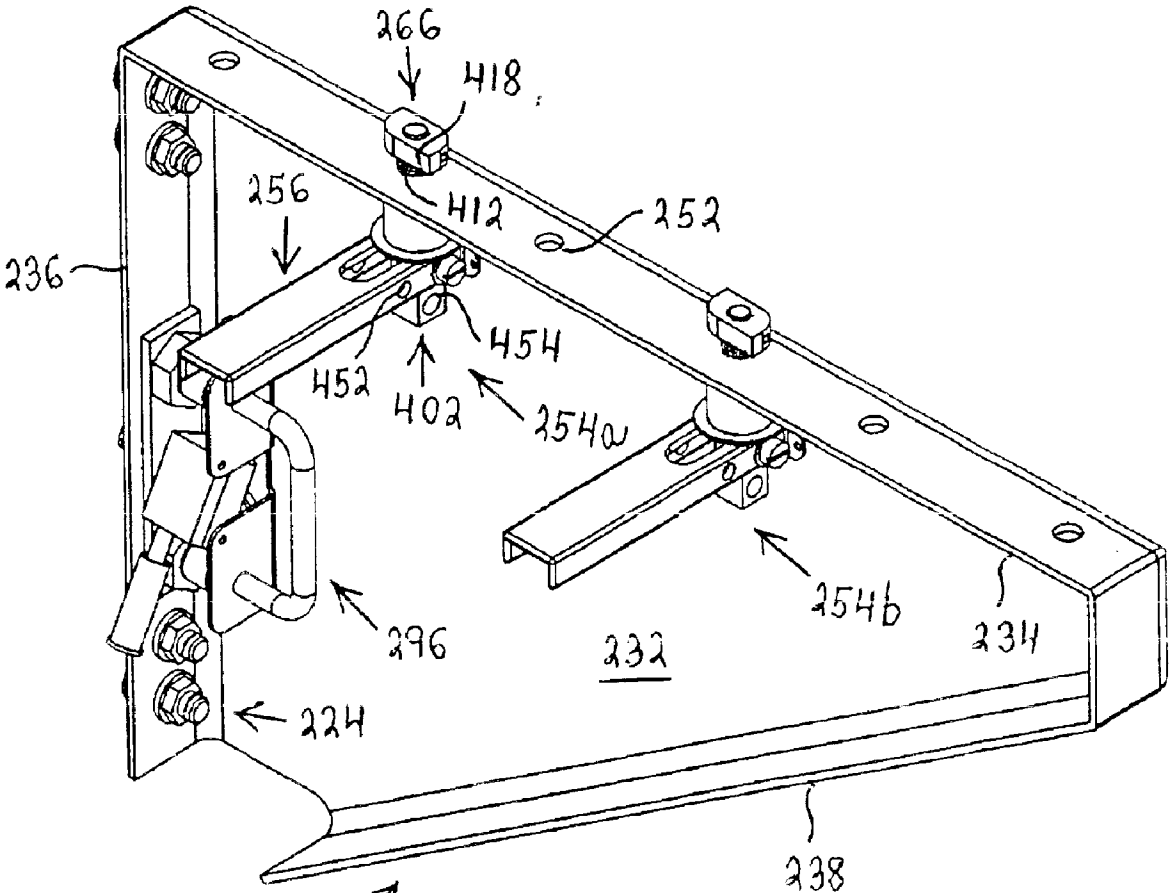
FIG. 10 is similar to FIG. 8 but shows the shelf locking units in another position again without the respective quick release pins and lanyards.

Once the grooves 418 are in alignment with the respective protrusions 462, the handle 256 is rotated downward through 90 degrees in a counterclockwise direction as seen in FIG. 10. This brings the handle 256 into the position of FIGS. 11 and 12 where the handle 256 extends vertically at a right angle to the flange 234.

The design is such that, as the handle 256 rotates downward, the cam surfaces 428 push upward on the washer 408. Since the washer 408 bears against the spacer 410 which, in turn, bears against the flange 234, the washer 408 is unable to move under the action of the cam surfaces 428. Hence, a downward force is exerted on the handle 256 and, through the shoulder screw 436, on the block 402 of the draw bolt 400. Consequently, the draw bolt 400 is drawn downward in response to the downward rotation of the handle 256.

The holding nut 266 which is fast with the draw bolt 400 is likewise drawn downward in response to the downward rotation of the handle 256. As the holding nut 266 moves downward, the coil spring 412 is compressed. Moreover, the two protrusions 462 in alignment with the two grooves 418 of the holding nut 266 enter the respective grooves 418. When the holding nut 266 completes its downward motion, the holding nut 266 exerts a downward force on the underlying protrusions 462 thereby urging the rails 272 which are associated with these protrusions 462 against the flange 234. Accordingly, such rails 272 are clamped between the holding nut 266 and the flange 234 so that the shelf 216 is fixed against movement relative to the mounting bracket 214*a* which includes the flange 234.

When the handle 256 is in the raised position of FIGS. 8–10, the holes 452 in the legs 420 of the handle 256 are out of register with the passage 454 in the block 402 of the draw bolt 400. Upon rotation of the handle 256 to its lowered position, the strip-shaped sections 426 of the handle 256 come into abutment with the block 402 while the holes 452 come into register with the passage 454. Once the holes 452 and the passage 454 are in register, the quick release pin 464 is inserted in the holes 452 and the passage 454. The quick release pin 464 prevents the handle 256 from being raised unintentionally or in response to an impact on the mounting bracket 214*a* or the shelf 216.

In the lowered position of the handle 256, the flat surfaces 430 on the legs 420 of the handle 256 rest against the washer 408.

Figure 11:
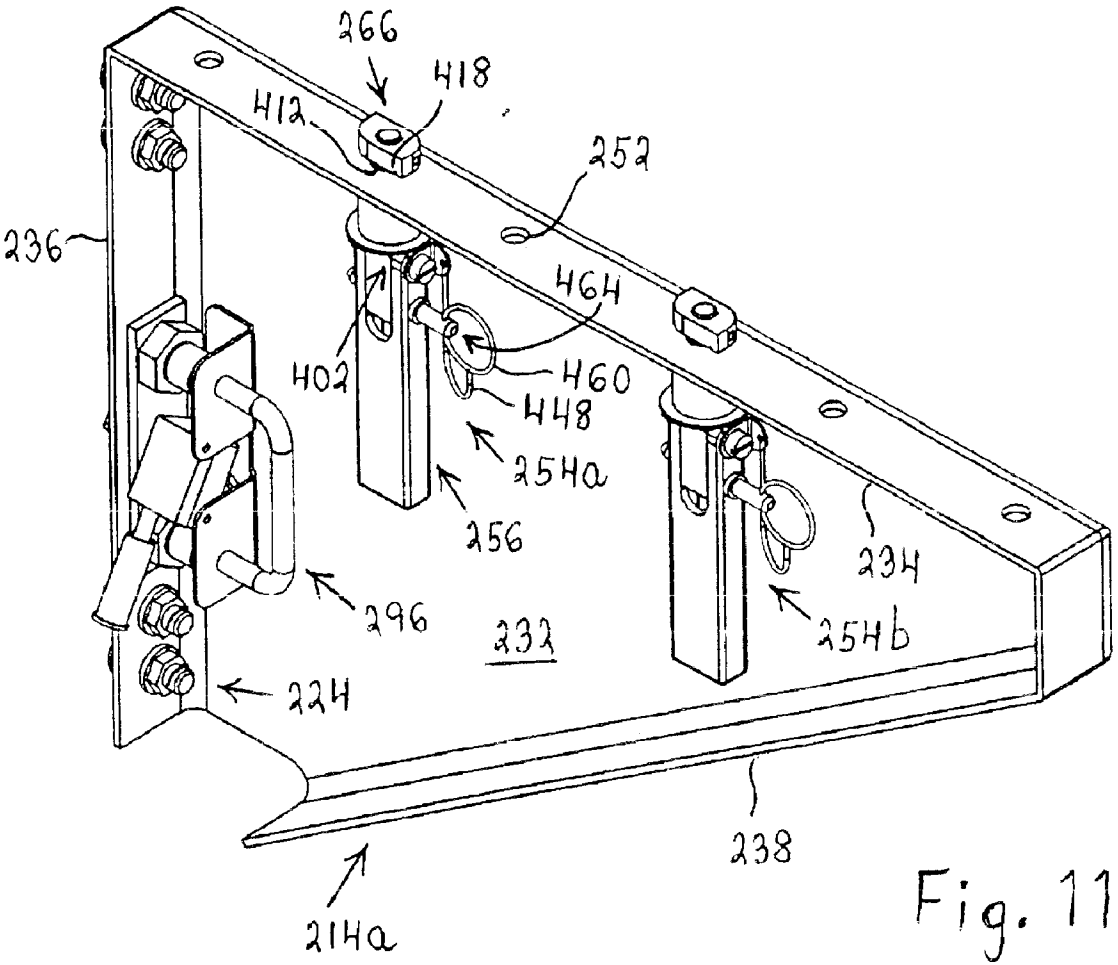
FIG. 11 is similar to FIG. 10 but shows the shelf locking units in an additional position.
Figure 12:
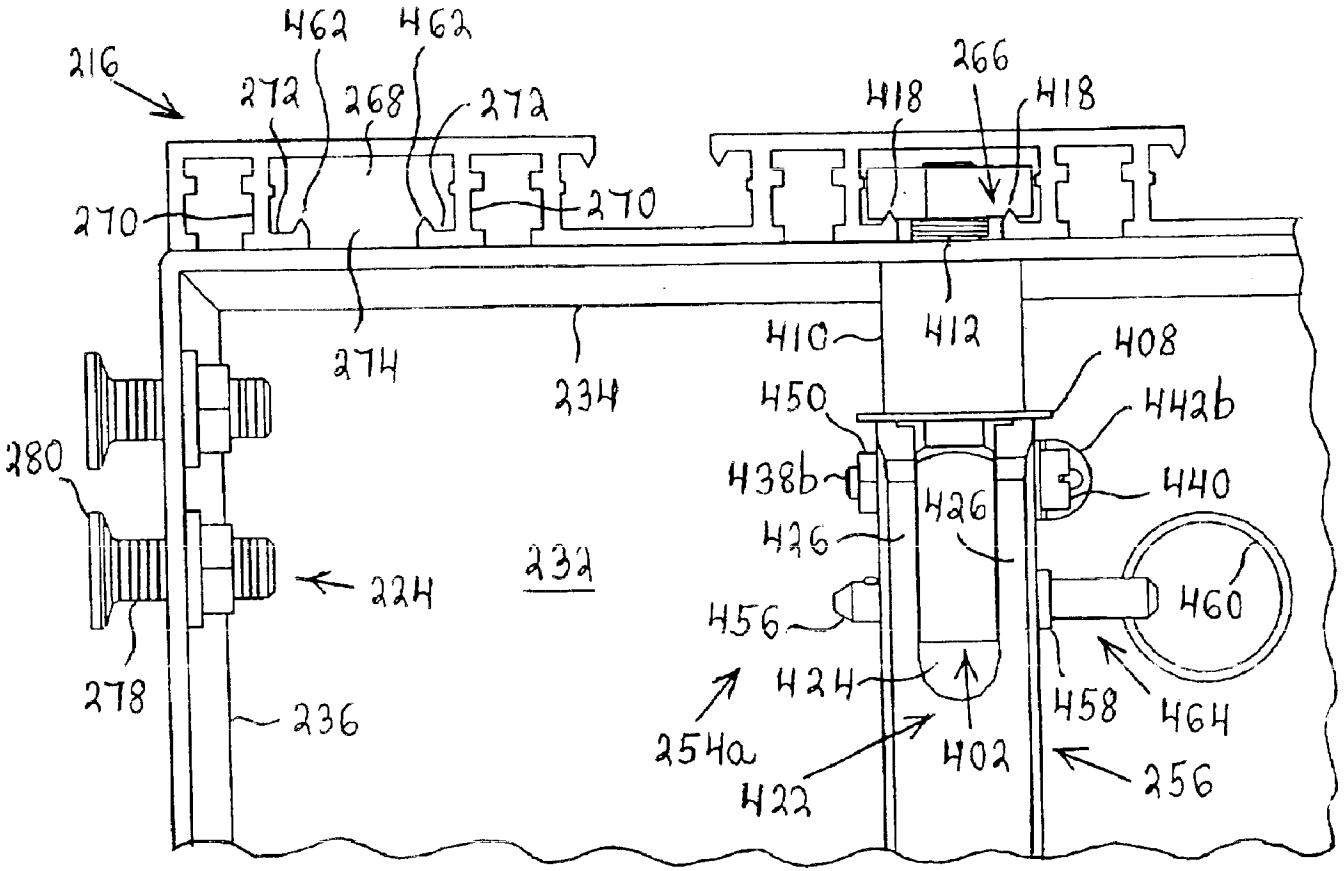
FIG. 12 is a fragmentary, partly perspective side view of the mounting bracket of FIG. 8 showing one of the two shelf locking units in the position of FIG. 11 but without the respective lanyard.

To release the shelf 216 from the mounting bracket 214*a*, the quick release pin 464 is removed from the holes 452 in the handle 256 and from the passage 454 in the block 402 of the draw bolt 400. The handle 256 is then pivoted upward through 90 degrees in a clockwise direction as seen in FIGS. 11 and 12 so that the handle 256 assumes the orientation of FIG. 10 in which the handle 256 extends horizontally normal to the flange 234.

As the handle 256 rotates upward, the coil spring 412 expands and pushes the holding nut 266 upward and away from the underlying protrusions 462 on the rails 272 of the shelf 216. The draw bolt 400 and its block 402, which are fast with the holding nut 266, likewise move upward. When the handle 256 completes its upward motion, the protrusions 462 are clear of the grooves 418 in the handle 256.

Once the handle 256 has been raised so that the protrusions 462 no longer project into the grooves 418, the handle 256 is rotated horizontally through 90 degrees in a clockwise direction as seen in FIG. 10. Accordingly, the handle 256 assumes the position of FIGS. 8 and 9 in which the handle 256 lies below the flange 234 and is parallel thereto.

Before the handle 256 is rotated horizontally, the length of the holding nut 266 is parallel to the length of the flange 234. During the horizontal rotation of the handle 256, the holding nut 266 also rotates and assumes a position in which the length of the holding nut 266 is perpendicular to the length of the flange 234. The shelf 216 can now be lifted from the mounting bracket 214*a* and its flange 234.

The preceding description relating to the locking unit 254*a* is applicable to the locking unit 254*b*. Furthermore, when the shelf 216 is secured to the mounting bracket 214*a*, the shelf 216 will typically be additionally secured to a second, non-illustrated mounting bracket equipped with two locking units identical to the locking units 254*a*, 254*b*.

Various modifications are possible within the meaning and range of equivalence of the appended claims.

What is claimed is:

1. A support system for loads comprising:

a brace provided with a plurality of first elements defining respective first receiving positions for a plurality of anchoring members designed to inhibit movement of said brace in a first direction, and at least one second element defining at least one second receiving position for arresting means designed to inhibit movement of said brace in a second direction different from said first direction, said plurality of first elements including two pairs of elements arranged so that the two elements of each pair have substantially the same predetermined center-to-center spacing, and said one second element and at least one of said first elements of said pairs having a center-to-center spacing different from said predetermined spacing and from an integral multiple of said predetermined spacing, said brace further being provided with at least one additional second element defining a receiving position for the arresting means designed to inhibit movement of said brace in said second direction, and said one additional second element and said one first element having a center-to-center spacing different from said predetermined spacing and from an integral multiple of said predetermined spacing.

2. The support system of claim 1, wherein said one second element and said additional second element have a center-to-center spacing substantially equal to said predetermined spacing or an integral multiple of said predetermined spacing.

3. The support system of claim 1, further comprising a mounting member designed to be affixed to a surface, said anchoring means being designed to anchor said brace to said mounting member so as to inhibit movement of said brace in said first direction.

4. A support system for loads comprising:

a brace provided with a plurality of first elements defining respective first receiving positions for a plurality of anchoring members designed to inhibit movement of said brace in a first direction, and at least one second element defining at least one second receiving position for arresting means designed to inhibit movement of said brace in a second direction different from said first direction, said plurality of first elements including two pairs of elements arranged so that the two elements of each pair have substantially the same predetermined center-to-center spacing, and said one second element and at least one of said first elements of said pairs having a center-to-center spacing different from said predetermined spacing and from an integral multiple of said predetermined spacing; and a mounting member designed to be affixed to a surface and to hold said brace, said mounting member being provided with a plurality of additional elements defining respective receiving positions for the plurality of anchoring members designed to inhibit movement of said brace in said first direction, and said additional elements also defining a receiving position for the arresting means designed to inhibit movement of said brace in said second direction, neighboring ones of said additional elements having a center-to-center spacing substantially equal to said predetermined spacing.

5. The support system of claim 4, wherein said one second element and said one first element have a center-to-center spacing substantially equal to one-half of said predetermined spacing, one and one-half times said predetermined spacing or an integral multiple of said predetermined spacing plus one-half of said predetermined spacing.

6. The support system of claim 4, wherein said first elements comprise openings in said brace.

7. The support system of claim 4, wherein said one second element comprises en opening in said brace.

8. The support system of claim 4, wherein said mounting member is provided with retaining elements between neighboring ones of said additional elements, said retaining elements being designed to cooperate with the plurality of anchoring members on said brace so as to inhibit movement of said brace in said first direction.

9. The support system of claim 8, wherein said additional elements comprise openings in said mounting member designed to receive the plurality of anchoring members on said brace with clearance and said retaining elements comprise undercuts designed to inhibit separation of the plurality of anchoring members from said mounting member.

10. The support system of claim 4, wherein said first elements and said second element are arranged in a row.

11. The support system of claim 4, wherein said brace is provided with means for mounting a shelf on said brace.

12. A support system for loads comprising:

arresting means; and a brace provided with a plurality of first elements defining respective first receiving positions for a plurality of anchoring members designed to inhibit movement of said brace in a first direction, and at least one second element defining at least one second receiving position for said arresting means, said arresting means being designed to inhibit movement of said brace in a second direction different from said first direction, and said plurality of first elements including two pairs of elements arranged so that the two elements of each pair have substantially the same predetermined center-to-center spacing, said one second element and at least one of said first elements of said pairs having a center-to-center spacing different from said predetermined spacing and from an integral multiple of said predetermined spacing, and said arresting means comprising at least one arresting member which is movable between an inoperative retracted condition and an operative extended condition when said one arresting member is at said one second position of said brace.

13. The support system of claim 12, further comprising means for biasing said arresting member towards said extended position.

14. The support system of claim 12, wherein said brace is provided with an additional second element defining an additional second position for said arresting means designed to inhibit movement of said brace in said second direction, said additional second element and said one first element having a center-to-center spacing different from said predetermined spacing and from an integral multiple of said predetermined spacing, and said arresting means comprising an additional arresting member which is movable between an inoperative retracted condition and an operative extended condition when said additional arresting member is at said additional second position.

15. The support system of claim 14, wherein said arresting members are spaced from one another by substantially the same distance as said second positions and are movable between the respective retracted and extended conditions substantially in tandem.

16. The support system of claim 12, further comprising a locking member for preventing movement of said one arresting member out of said one second position.

17. The support system of claim 16, wherein said locking member comprises a cam.

18. A bracing method comprising the steps of:

anchoring a brace at a plurality of first locations of said brace so as to inhibit movement of said brace in a first direction, said plurality of first locations including two pairs of locations arranged so that the two locations of each pair have substantially the same predetermined center-to-center spacing; and arresting said brace at a minimum of one second location of said brace so as to inhibit movement of said brace in a second direction different from said first direction, said one second location and at least one of said first locations of said pairs having a center-to-center spacing different from said predetermined spacing and from an integral multiple of said predetermined spacing, and the arresting step comprising moving at least one arresting member from a retracted inoperative condition to an extended operative condition at said one second location.

19. The method of claim 18, wherein said one second location and said one first location have a center-to-center spacing substantially equal to one-half of said predetermined spacing, one and one-half times said predetermined spacing, or an integral multiple of said predetermined spacing plus one-half of said predetermined spacing.

20. The method of claim 18, wherein said brace is arrested at an additional second location of said brace so as to inhibit movement of said brace in said second direction, said additional second location and said one first location having a center-to-center spacing different from said predetermined spacing and from an integral multiple of said predetermined spacing.

21. The method of claim 20, wherein said one second location and said additional second location have a center-to-center spacing substantially equal to said predetermined spacing or an integral multiple of said predetermined spacing.

22. The method of claim 18, wherein said first locations and said one second location are arranged in a row.

23. The method of claim 18, wherein said arresting member is biased towards said extended operative condition.

24. The method of claim 18, wherein said brace is arrested at an additional second location of said brace so as to inhibit movement of said brace in said second direction, said additional second location and said one first location having a center-to-center spacing different from said predetermined spacing or an integral multiple of said predetermined spacing, and the arresting step comprising moving an additional arresting member from a retracted inoperative condition to an extended operative condition at said additional second location.

25. The method of claim 24, wherein said one arresting member and said additional arresting member are moved to the respective extended positions substantially in tandem.

26. The method of claim 18, further comprising the step of locking said one arresting member against movement away from said one second location.

* * * * *